US006485273B1

(12) United States Patent
Goodwin-Johansson

(10) Patent No.: US 6,485,273 B1
(45) Date of Patent: Nov. 26, 2002

(54) DISTRIBUTED MEMS ELECTROSTATIC PUMPING DEVICES

(75) Inventor: Scott H. Goodwin-Johansson, Pittsboro, NC (US)

(73) Assignee: MCNC, Research Triangle Park, NC (US)

( * ) Notice: Subject to any disclaimer, the term of this patent is extended or adjusted under 35 U.S.C. 154(b) by 0 days.

(21) Appl. No.: 09/654,446

(22) Filed: Sep. 1, 2000

(51) Int. Cl.[7] ..... F04B 45/047

(52) U.S. Cl. ..... 417/410.2; 310/309; 417/436

(58) Field of Search ..... 417/410.1, 413.1, 417/410.2, 413.3, 322, 540, 436; 310/309

(56) References Cited

U.S. PATENT DOCUMENTS

| | | | |
|---|---|---|---|
| 2,851,618 | A | 9/1958 | Krawinkel |
| 2,927,255 | A | 3/1960 | Diesel |
| 2,942,077 | A | 6/1960 | Diesel |
| 3,772,537 | A | 11/1973 | Clifford et al. |
| 3,796,976 | A | 3/1974 | Heng et al. |
| 4,317,611 | A | 3/1982 | Petersen |
| 4,516,091 | A | 5/1985 | Sasser |
| 4,554,519 | A | 11/1985 | Adam |
| 4,581,624 | A | 4/1986 | O'Connor |
| 4,598,585 | A | 7/1986 | Boxenhorn |
| 4,662,746 | A | 5/1987 | Hornbeck |
| 4,692,727 | A | 9/1987 | Wakino et al. |
| 4,710,732 | A | 12/1987 | Hornbeck |
| 4,736,202 | A | 4/1988 | Simpson et al. |
| 4,747,670 | A | 5/1988 | Devio et al. |
| 4,789,803 | A | 12/1988 | Jacobsen et al. |
| 4,794,370 | A | 12/1988 | Simpson et al. |
| 4,857,757 | A | 8/1989 | Sato et al. |
| 5,016,072 | A | 5/1991 | Greiff |
| 5,043,043 | A | 8/1991 | Howe et al. |
| 5,051,643 | A | 9/1991 | Dworsky et al. |
| 5,061,049 | A | 10/1991 | Hornbeck |

(List continued on next page.)

FOREIGN PATENT DOCUMENTS

| | | |
|---|---|---|
| DE | 42 35 593 A1 | 10/1993 |
| EP | 0 665 590 A2 | 8/1995 |
| EP | 0 834 759 A2 | 4/1998 |
| WO | WO 99/26333 | 5/1999 |

OTHER PUBLICATIONS

J.A. Walker, K.W. Goossen, S.C. Arney, N.J. Frigo and P.P. Iannone, "A Silicon Optical Modulator With 5 MHz Operation For Fiber–In–The–Loop Applications"; The 8th International Conference on Solid State Sensors and Actuators and Eurosensors IX, Stockholm, Sweden, Jun. 25–29, 1995, Digest of Technical Papers, vol. 1, Sessions A1–PD6, No. 1–231, pp. 285–288, MCNC 168–172.

(List continued on next page.)

*Primary Examiner*—Michael Koczo
(74) *Attorney, Agent, or Firm*—Alston & Bird LLP

(57) ABSTRACT

A MEMS pumping device driven by electrostatic forces comprises a substrate having at least one substrate electrode disposed thereon. Affixed to the substrate is a moveable membrane that generally overlies the at least one substrate electrode. The moveable membrane comprises at least one electrode element and a biasing element. The moveable membrane includes a fixed portion attached to the substrate and a distal portion extending from the fixed portion and being moveable with respect to the substrate electrode. A dielectric element is disposed between the at least one substrate electrode and the at least one electrode element of the moveable membrane to provide for electrical isolation. In operation, a voltage differential is established between the at least one substrate electrode and the at least one electrode element which displaces the moveable membrane relative to the substrate to thereby controllably distribute matter residing between the substrate and the distal portion of the moveable membrane. In a further embodiment the MEMS pumping devices comprise more that two moveable membranes that are configured so as to maximize flow in a desired direction. Additional embodiments include more than one electrode element disposed within the moveable membrane that are capable of individual and sequential biasing to improve overall net flow in the desired flow direction.

58 Claims, 5 Drawing Sheets

U.S. PATENT DOCUMENTS 5,083,857 A 1/1992 Hornbeck
5,096,388 A * 3/1992 Weinberg ..... 417/413.1
5,097,354 A 3/1992 Goto
5,164,688 A 11/1992 Larson
5,168,249 A 12/1992 Larson
5,172,262 A 12/1992 Hornbeck
5,179,499 A 1/1993 MacDonald et al.
5,202,785 A 4/1993 Nelson
5,203,208 A 4/1993 Bernstein
5,212,582 A 5/1993 Nelson
5,233,459 A 8/1993 Bozler et al.
5,258,591 A 11/1993 Buck
5,260,596 A 11/1993 Dunn et al.
5,268,696 A 12/1993 Buck et al.
5,278,368 A 1/1994 Kasano et al.
5,311,360 A 5/1994 Bloom et al.
5,349,855 A 9/1994 Berstein et al.
5,353,656 A 10/1994 Hawkey et al.
5,367,136 A 11/1994 Buck
5,367,584 A 11/1994 Ghezzo et al.
5,392,650 A 2/1995 O'Brien et al.
5,408,355 A 4/1995 Rauch et al.
5,408,877 A 4/1995 Greiff et al.
5,479,042 A 12/1995 James et al.
5,488,863 A 2/1996 Mochida et al.
5,492,596 A 2/1996 Cho
5,496,436 A 3/1996 Bernstein et al.
5,507,911 A 4/1996 Greiff
5,515,724 A 5/1996 Greiff et al.
5,530,342 A 6/1996 Murphy
5,535,902 A 7/1996 Greiff
5,536,963 A 7/1996 Polla
5,536,988 A 7/1996 Zhang et al.
5,543,765 A 8/1996 Cachier
5,544,001 A 8/1996 Ichiya et al.
5,552,925 A 9/1996 Worley
5,578,976 A 11/1996 Yao
5,616,864 A 4/1997 Johnson et al.
5,619,061 A 4/1997 Goldsmith et al.
5,620,933 A 4/1997 James et al.
5,627,396 A 5/1997 James et al.
5,629,565 A 5/1997 Schlaak et al.
5,629,790 A 5/1997 Neukermans et al.
5,635,638 A 6/1997 Geen
5,635,639 A 6/1997 Greiff et al.
5,635,640 A 6/1997 Geen
5,635,739 A 6/1997 Grieff et al.
5,638,946 A 6/1997 Zavracky
5,640,133 A 6/1997 MacDonald et al.
5,650,568 A 7/1997 Greiff et al.
5,652,374 A 7/1997 Chia et al.
5,656,778 A 8/1997 Roszhart
5,658,698 A * 8/1997 Yagi et al. ..... 310/309
5,661,592 A 8/1997 Bornstein et al.
5,666,258 A 9/1997 Gevatter et al.
5,673,139 A 9/1997 Johnson
5,673,785 A 10/1997 Schlaak et al.
5,677,823 A 10/1997 Smith
5,696,662 A 12/1997 Bauhahn
5,723,894 A 3/1998 Ueno et al.
5,818,683 A 10/1998 Fujii
5,861,703 A 1/1999 Losinski
5,862,003 A 1/1999 Saif et al.
5,914,553 A 6/1999 Adams et al.
5,994,750 A * 11/1999 Yagi ..... 310/309
6,116,517 A * 9/2000 Heinzl et al. ..... 417/410.2
6,127,908 A * 10/2000 Bozler et al. ..... 330/66
6,168,395 B1 * 1/2001 Quenzer et al. ..... 417/413.3
6,179,586 B1 * 1/2001 Herb et al. ..... 417/322
6,227,824 B1 * 5/2001 Stehr ..... 417/540

OTHER PUBLICATIONS

M. Elwenspoek, L. Smith and B. Hök; "Active Joints For Microrobot Limbs"; J. Micromech. Microeng. 2 (1992); pp. 221–223.

Raj B. Apte, Francisco S. A. Sandejas, William C. Banyai, and David M. Bloom; "Deformable Grating Light Valves For High Resolution Displays"; Solid–State and Actuator Workshop, Hilton Head, South Carolina, Jun. 13–16, 1994; pp. 1–6.

Christopher W. Storment, David A. Borkholder, Victor A. Westerlind, John W. Suh, Nadim I. Maluf, and Gregory T. A. Kovacs; "Dry–Released Process For Aluminum Electrostatic Actuators"; Solid–State Sensor and Actuator Workshop, Hilton Head, South Carolina, Jun. 13–16, 1994; pp. 95–98.

Rob Legtenberg, Erwin Berenschot, Miko Elwenspoek and Jan Fluitman; "Electrostatic Curved Electrode Actuators"; IEEE Catalog No. 95CH35754, Amsterdam, The Netherlands, Jan. 29–Feb. 2, 1995; pp. 37–42.

U. Breng, T. Gessner, C. Kaufmann, R. Kiehnscherf, and J. Markert; "Electrostatic Micromechanic Actuators"; J. Micromech. Microeng 2 (1992); pp. 256–261.

J. Haji–Babaer, C. Y. Kwok and R.S. Huang; "Integrable Active Microvalve With Surface Micromachined Curled–Up Actuator"; Transducers '97, 1997 International Conference on Solid–State Sensors and Actuators, Chicago, Jun. 16–19, 1997, pp. 833–836.

V.P. Jaecklin, C. Linder, J. Brugger, J.M. Moret, R. Vuilleumier and N.F. de Rooij; "Mechanical and Optical Properties of Surface Micromachined Torsional Mirrors in Silicon, Polysilicon and Aluminum"; pp. 958–961; MCNC 1562–1565; The 7th International Conference on Solid–State Sensors and Actuators.

Devi S. Gunawan, Lih–Yuan Lin, and Kristofer S.J. Pister; "Micromachined Corner Cube Reflectors as a Communication Link"; Sensors and Actuators, A 46–47 (1995), pp. 580–583.

V.P. Jaecklin, C. Linder, and N.F. de Rooij; "Optical Microshutters and Torsional Micromirrors For Light Modulator Arrays"; 4 pages.

Erno H. Klaassen, Kurt Petersen, J. Mark Noworolski, John Logan, Nadim I. Maluf, Joe Brown, Christopher Storment, Wendell McCulley, and Gregory T. A. Kovacs; "Silicon Fusion Bonding and Deep Reactive Ion Etching; A New Technology for Microstructures"; The 8th International Conference on Solid–State Sensors and Actuators, and Eurosensors IX, Stockholm, Sweden, Jun. 25–29, 1995, pp. 556–559.

Dr. Kurt Petersen; "Single Crystal Silicon Actuators and Sensors Based on Silicon Fusion Bonding Technology"; Semi–Annual Progress Report 1 prepared for Advanced Research Projects Agency, Lucas NovaSensor, Fremont, California, Jul. 1994, pp. 1–13.

Dr. Kurt Petersen; "Single Crystal Silicon Actuators and Sensors Based on Silicon Fusion Bonding Technology"; Semi–Annual Progress Report 2 prepared for Advanced Research Projects Agency, Lucas NovaSensor, Fremont, California, Jan. 1995, pp. 1–18.

R.N. Kleiman, G.K. Kaminsky, J.D. Reppy, R. Pindak, and D.J. Bishop; "Single–Crystal Silicon High–Q Torsional Oscillators"; pp. 2088–2091, MCNC 1710–1713; Rev. Sci. Instrum. 58 (11), Nov. 1985.

Kurt E. Petersen; "Silicon Torsional Scanning Mirror"; IBM J. Res. Develop., vol. 24, No. 5, Sep. 1980, pp. 631–637.

B. Diem, M.T. Delaye, F. Michel, S. Renard, G. Delapierre; "SOI (Simox) as a Substrate for Surface Micromachining of Single Crystalline Silicon Sensors and Actuators"; The 7th International Conference on Solid–State Sensors and Actuators; pp. 233–236; MCNC 1554–1557.

M. Elwenspoek, M. Weustink and R. Legtenberg; "Static and Dynamic Properties of Active Joints"; The 8th International Conference on solid–State Sensors and Actuators, and Eurosensors IX, Stockholm, Sweden, Jun. 25–29, 1995, pp. 412–415.

Ignaz Schiele, Jörg Huber, Bernd Hillerich, and Frank Kozlowski; "Surface–Micromachined Electrostatic Microrelay"; Sensors and Actuators A 66 (1998), pp. 345–354.

K. Deng, H. Miyajima, V.R. Dhuler, M. Mehregany, S.W. Smith, F.L. Merat, and S. Furukawa; "The Development of Polysilicon Micromotors for Optical Scanning Applications"; Electronics Design Center, Dept. of Electrical Engineering and Applied Physics, Case Western Reserve University, Cleveland, OH; 5 pages.

"Very High Q–Factor Resonators in Monocrystalline Silicon"; Sensors and Actuators A21–A23 (1990); MCNC 1705–1709, pp. 232–327.

* cited by examiner

DISTRIBUTED MEMS ELECTROSTATIC PUMPING DEVICES

FIELD OF THE INVENTION

The present invention relates to microelectromechanical system (MEMS) pumping devices, and more particularly to low-power, distributed MEMS pumping devices that are electrostatically actuated and the associated methods of using such devices.

BACKGROUND OF THE INVENTION

Advances in thin film technology have enabled the development of sophisticated integrated circuits. This advanced semiconductor technology has also been leveraged to create MEMS (Micro Electro Mechanical System) structures. MEMS structures are typically capable of motion or applying force. Many different varieties of MEMS devices have been created, including microsensors, microgears, micromotors, and other microengineered devices. MEMS devices are being developed for a wide variety of applications because they provide the advantages of low cost, high reliability and extremely small size.

Design freedom afforded to engineers of MEMS devices has led to the development of various techniques and structures for providing the force necessary to cause the desired motion within microstructures. For example, microcantilevers have been used to apply rotational mechanical force to rotate micromachined springs and gears. Electromagnetic fields have been used to drive micromotors. Piezoelectric forces have also been successfully been used to controllably move micromachined structures. Controlled thermal expansion of actuators or other MEMS components has been used to create forces for driving microdevices. One such device is found in U.S. Pat. No. 5,475,318 entitled "Microprobe" issued Dec. 12, 1995 in the name of inventors Marcus et al., which leverages thermal expansion to move a microdevice. A micro cantilever is constructed from materials having different thermal coefficients of expansion. When heated, the bimorph layers arch differently, causing the micro cantilever to move accordingly. A similar mechanism is used to activate a micromachined thermal switch as described in U.S. Pat. No. 5,463,233 entitled "Micromachined Thermal Switch" issued Oct. 31, 1995 in the name of inventor Norling.

Electrostatic forces have also been used to move structures. Traditional electrostatic devices were constructed from laminated films cut from plastic or mylar materials. A flexible electrode was attached to the film, and another electrode was affixed to a base structure. Electrically energizing the respective electrodes created an electrostatic force attracting the electrodes to each other or repelling them from each other. A representative example of these devices is found in U.S. Pat. No. 4,266,339 entitled "Method for Making Rolling Electrode for Electrostatic Device" issued May 12, 1981 in the name of inventor Kalt. These devices work well for typical motive applications, but these devices cannot be constructed in dimensions suitable for miniaturized integrated circuits, biomedical applications, or MEMS structures.

MEMS electrostatic devices are used advantageously in various applications because of their extremely small size. Electrostatic forces due to the electric field between electrical charges can generate relatively large forces given the small electrode separations inherent in MEMS devices. An example of these devices can be found in U.S. patent application Ser. No. 09/345,300 entitled "ARC resistant High Voltage Micromachined Electrostatic Switch" filed on Jun. 30, 1999 in the name of inventor Goodwin-Johansson and U.S. patent application Ser. No. 09/320,891 entitled "Micromachined Electrostatic Actuator with Air Gap" filed on May 27, 1999 in the name of inventor Goodwin-Johansson. Both of these applications are assigned to MCNC, the assignee of the present invention.

It would be advantageous to develop MEMS pumping devices using electrostatic actuation that are capable of providing both large displacements of matter (typically liquid but also gasses and semi-liquid/semi-solid compositions) and large forces. The electrostatic nature of the MEMS pumping device will allow for relatively low power consumption and, therefore, no unwarranted heating of the flowing gas or fluid would occur. Additionally, the electrostatic pumping device will provide for relatively fast operation, allowing for more precise control of the pumped volume and pumping rate. In addition, it would be advantageous to develop a MEMS pumping device that allows for flow in a single predetermined direction.

Additionally, a need exists to provide for MEMS pumping devices that are capable of being used in unison to provide highly directional flow in a predetermined direction and are also capable of being patterned in an array on a substrate so as to provide for comprehensive pumping of the fluid or gas. For example, by providing for pumping devices that can be shaped and oriented on the substrate it is possible to selectively power the different pumping elements in a predetermined sequence to result in fluid or gas flow in a desired direction. This type of highly directional flow is desired in many applications, including biomedical applications and the like. Additionally, by developing a MEMS pumping device capable of being distributed in patterned arrays over the entire interior surface of a chamber or conduit it is possible to effectively pump the entire matter since the boundary of the matter is moving where the drag force exists. The individual pumping device elements of an array could be individually addressable so that the pumping matter can be directed in different directions as the application warrants.

As such, MEMS electrostatic pumping devices that have improved performance characteristics are desired for many applications. For example, MEMS pumping devices capable of fast actuation, large pumping force and large displacements that utilize minimal power are desirable, but are currently unavailable. Such devices have immediate need in those applications that desire highly directed flow, comprehensive pumping throughout an enclosed region or the ability to change flow directions by sequencing the activation of the pumping devices.

SUMMARY OF THE INVENTION

The present invention provides for improved MEMS electrostatic pumping devices that can provide large pumping force, fast actuation and large displacement of pumped matter. Further, methods for using the MEMS pumping devices according to the present invention are provided.

A MEMS pumping device driven by electrostatic forces according to the present invention comprises a substrate having at least one substrate electrode disposed thereon. Affixed to the substrate is a moveable membrane that generally overlies the at least one substrate electrode. The moveable membrane comprises at least one electrode element and a biasing element. The moveable membrane includes a fixed portion attached to the substrate and a distal portion extending from the fixed portion and being moveable with respect to the substrate electrode. A dielectric element is disposed between the at least one substrate electrode and the at least one electrode element of the moveable membrane to provide for electrical isolation. In operation, a voltage differential is established between the at least one substrate electrode and the at least one electrode element which displaces the moveable membrane relative to the substrate to thereby controllably distribute matter residing between the substrate and the distal portion of the moveable membrane.

In a further embodiment of the invention the MEMS pumping devices comprises two moveable membranes adjacently positioned on the substrate so as to impart greater desired directional pumping capability. The moveable membranes may comprise more than one electrode element. Multiple electrode elements may be individually and sequentially biased to impart greater control of directional pumping capability. The fixed portion of the moveable membranes may be limited to a corner of the membrane to allow for the pumping cavity to fill from an upstream edge of the membrane and thereby impart greater overall net flow in the desired direction.

In another embodiment of the invention the MEMS pumping device comprises one rectangular plan view shaped moveable membrane and two triangular plane view shaped moveable membranes disposed adjacent to opposite sides of the rectangular plan view shaped membrane. The moveable membranes may comprise more than one electrode element. Multiple electrode elements may be individually and sequentially biased to impart greater control of directional pumping capability. The individual moveable membranes may be sequentially biased to impart greater control of directional pumping capability.

In yet another embodiment of the invention the MEMS pumping device comprises two rectangular plan view shaped moveable membrane and two triangular plane view shaped moveable membranes disposed adjacent to opposite sides of the rectangular plan view shaped membranes. The moveable membranes may comprise more than one electrode element. Multiple electrode elements may be individually and sequentially biased to impart greater control of directional pumping capability. The fixed portion of the moveable membranes may be limited to a corner of the membrane to allow for the pumping cavity to fill from an upstream edge of the membrane and thereby impart greater overall net flow in the desired direction.

The invention is also embodied in a MEMS pumping device array that incorporates more than one MEMS pumping device disposed on a substrate. The array may be configured so that it maximizes pumping force and requisite unidirectional or multidirectional pumping direction. The substrate will typically be flexible so that it may line or form the interior walls of a conduit, chamber or the like.

In yet another embodiment, the invention comprises a method for using a MEMS pumping device. The method comprises biasing a first electrode element in a MEMS electrostatic moveable membrane. The first electrode is disposed along an upstream flow edge of the moveable membrane creating an "attached" edge. The biasing of the first electrode element is followed by biasing at least one second electrode element in the MEMS electrostatic moveable membrane. The at least one second electrode element is disposed in a distal portion of the moveable membrane. Once the moveable membrane has been fully biased the release process involves releasing bias on the first electrode element while maintaining bias on the at least one second electrode element. Releasing bias on the first electrode element allows for the pumped matter (e.g. fluids or gasses) to fill the pump region from the upstream flow edge of the moveable membrane. Lastly, bias is released on the at least one second electrode to allow for the matter to fully fill the pump region.

The MEMS electrostatic pumping devices of the present invention have improved performance characteristics that are highly desirable for many micro applications. The MEMS pumping devices of the present invention are capable of fast actuation, large pumping force and large displacements while utilizing minimal power. Such devices have immediate need in those applications that desire highly directed flow, comprehensive pumping throughout an enclosed region and/or the ability to change flow directions by sequencing the activation of the pumping devices.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
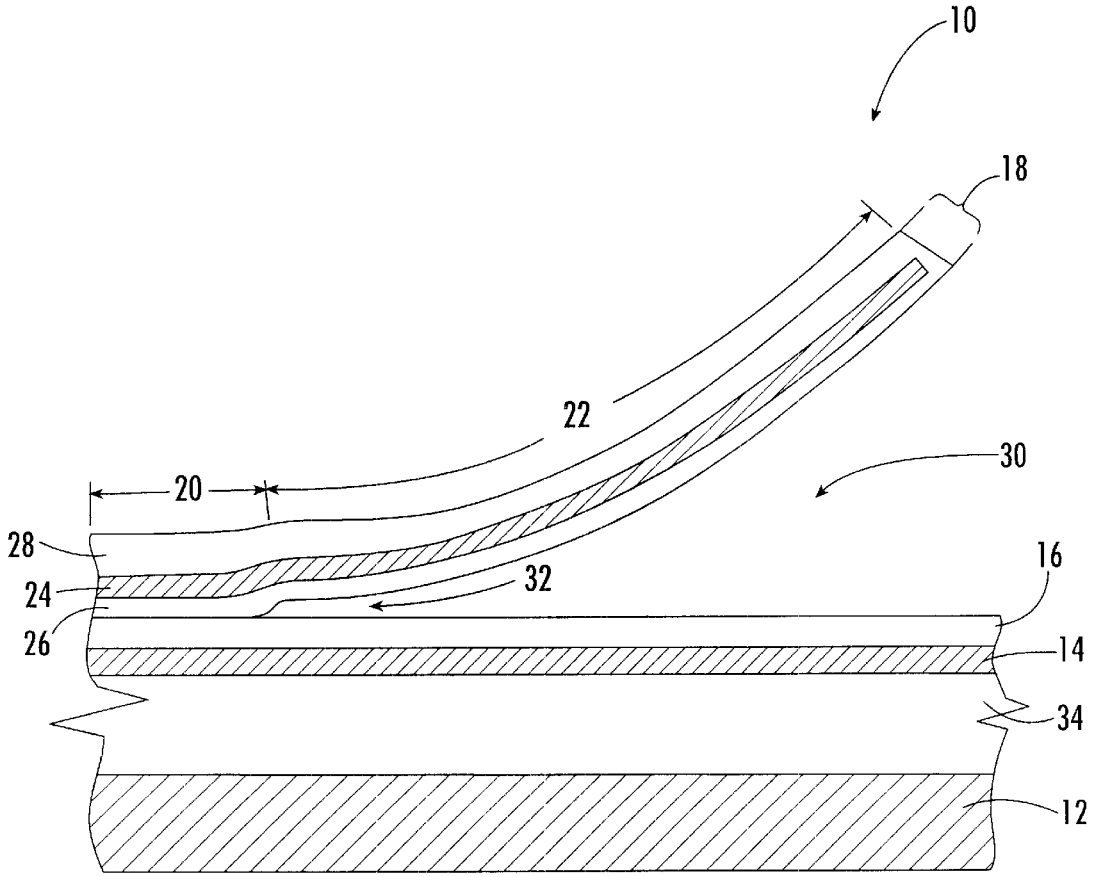
FIG. 1 is a cross-sectional view of a simplified single moveable membrane MEMS pumping device in accordance with an embodiment of the present invention.
Figure 2:
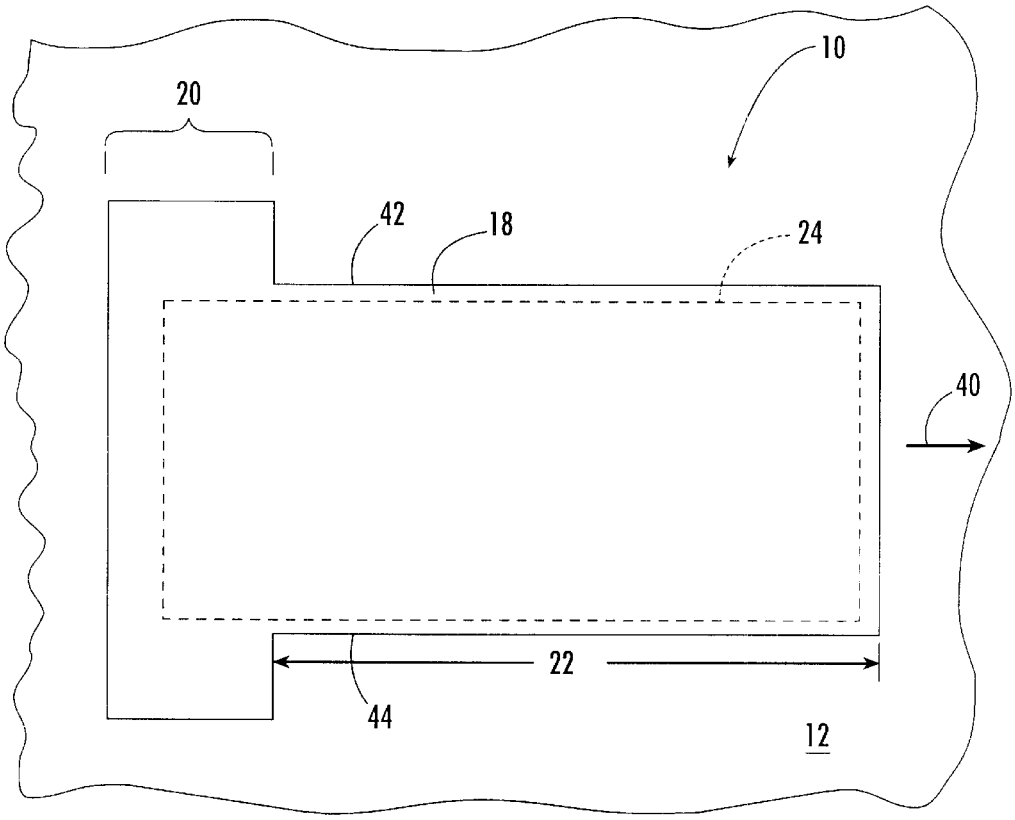
FIG. 2 is a top plan view of a simplified single moveable membrane MEMS pumping device in accordance with an embodiment of the present invention.

Referring to FIGS. 1 and 2, shown are cross-sectional and plan view diagrams of the simplified structure of a MEMS electrostatic pump device, in accordance with an embodiment of the present invention. The MEMS electrostatic pump 10 of the present invention can be used to pump fluids or gasses in a distributed fashion. The pump can be employed in MEMS fluidics devices or larger macroscopic systems that require relatively lower power and ease of fabrication. In a first embodiment as shown in FIG. 1, the MEMS electrostatic pump device comprises in layers, a substrate 12, a substrate electrode 14, a dielectric element 16, and a moveable membrane 18. The moveable membrane is typically a flexible composite that overlies the substrate and substrate electrode. Along its length, the moveable membrane has a fixed portion 20 and a distal portion 22. The fixed portion is substantially affixed to the underlying substrate or intermediate layers. The distal portion extends from the fixed portion and is released from the underlying substrate during the fabrication process.

The moveable membrane 18 comprises multiple layers including at least one electrode element 24 and one or more biasing elements 26 and 28. The number of layers, thickness of layers, arrangement of layers, and choice of materials used may be selected to cause the moveable membrane to curl toward, curl away, or remain parallel to the underlying substrate electrode. Thus, the distal portion can be biased to curl as it extends away from the fixed portion. In operation, electrostatic voltage is applied across the substrate electrode 14 and the at least one electrode element 24 to cause the moveable membrane to be attracted towards the substrate electrode. This attractive force causes the moveable membrane to unroll and, thus, alters the separation between the moveable membrane and the underlying substrate. This motion forces the fluids or gasses that lie in the pump region 30 (the region between the moveable membrane and the underlying substrate) out from under the membrane with a general motion parallel to the substrate and away from the attached fixed portion 20 of the moveable membrane.

When the voltage is released the intrinsic stress in the moveable membrane 18 curls the membrane in the direction that the membrane is biased, in this instance, away from the substrate. By controlling the rate at which the voltage is released and/or the direction from which the fluid or gasses enter under the flap as the membrane pulls away from the substrate 12, a net motion is imparted to the fluid or- gas averaged over the pumping cycle. Relatively small voltages are required to fully attract the moveable membrane to the substrate because the generally tangential gap 32 at the onset of the distal portion 22 provides minimal space between the electrode element 24 in the moveable membrane and the substrate electrode 14.

The pumping capacity is determined by the volume of the pump region 30 and the rate at which the moveable membrane 18 can be attracted and released from the substrate. A rapid closing of the flexible membrane increases the directional nature of the expelled material from the pump region while a slow opening of the flexible membrane increases the multi-directional refilling of the pump volume, increasing the net motion imparted to the fluid or gas. Longer moveable membranes (i.e. longer distal portions 22) will increase the volume of the pump region both due to the length and also the height of the moveable membrane in the relaxed state (i.e. the "up" position shown in FIG. 1). It should be noted, however, that length of the moveable membrane is limited in all instances to insure that the membrane does not curl back on itself upon release of the electrostatic voltage. This phenomenon would typically cause a source of drag on the fluid or gas flow and likely would not produce increased pumping volumes since the film will no longer "cover" the additional volume.

Referring again to FIG. 1, the MEMS electrostatic pumping device 10 is constructed upon a substrate 12. Preferably, the substrate comprises a silicon wafer, although any suitable substrate material can be used. For instance, other semiconductor materials, glass, plastics, or other materials may serve as the substrate. It should be noted that the substrate need not be a rigid structure but rather it may be a flexible substrate. A flexible substrate is more conducive to applications in which the MEMS pumping device or an array of pumping devices is located within a conduit, chamber or similar apparatus. In such applications the substrate may either line the interior of the chamber or conduit or form the interior walls of the chamber or conduit. A substrate insulating layer 34 may typically be deposited on the substrate and provides electrical isolation between the substrate and the subsequently deposited substrate electrode 14. In certain embodiments that implement substrate materials having strong insulation characteristics it may be possible to form the MEMS electrostatic pump device without the substrate insulating layer. It will be understood by those having ordinary skill in the art that when a layer or element is described herein as being "on" another layer or element, it may be formed directly on the layer, at the top, bottom or side surface area, or one or more intervening layers may be provided between the layers.

The insulating layer 34 preferably comprises a non-oxidation based insulator or polymer, such as polyimide or nitride. Oxide based insulators are discouraged from being used if certain acids/etchants, such as hydrofluoric acid, are used in processing to remove the release layer. However, other insulators, even oxide based insulators, may be used if release layer materials and compatible acids or etchants are used for removing the release layer. For instance, silicon dioxide could be used for the insulating layers if etchants not containing hydrofluoric acid are used. The substrate insulating layer is preferably formed by using a standard deposition technique, such as low-pressure chemical vapor deposition (LPCVD) or conventional spinning, to deposit the insulating layer on the substrate.

A substrate electrode 14 is deposited on the insulating layer 34, as shown in FIG. 1, or the substrate electrode may be deposited on the substrate 12. The substrate electrode preferably comprises a gold layer deposited on the top surface of the insulating layer. In applications that implement gold as the substrate electrode a thin layer of chromium (not shown in FIG. 1) may be deposited prior to depositing the electrode or after depositing the electrode to allow for better adhesion to the substrate or subsequent dielectric element 16. Alternatively, other metallic or conductive materials may be used so long as they provide adequate conductivity and are not adversely affected by subsequent release layer processing operations. The surface area and shape of the substrate electrode 14 can be varied as required to create the desired electrostatic forces. In most applications the substrate electrode will be photolithographically patterned with a photoresist and etch process so that it underlies the entirety of the electrode element 24 in the moveable membrane 18 to insure the maximum possible closing force of the pump.

A dielectric element 16 is deposited on the substrate electrode 14 to electrically isolate the substrate electrode 14 from the electrode element 24 in the moveable membrane 18. The dielectric element insures electrical isolation between the substrate electrode and the electrode element of the moveable membrane. The dielectric element should be formed of a generally thin layer of material to maximize electrostatic force but should be thick enough that it does not break down electrically. In certain embodiments it may be possible to construct the MEMS electrostatic pump device with the dielectric element being located in the moveable membrane and not on the substrate construct. However, in most applications, the dielectric element will preferably be deposited on the substrate to insure adequate electrical isolation. The dielectric element 16 preferably comprises polyimide, although other dielectric insulators or polymers tolerant of release layer processing may also be used. The substrate dielectric layer is formed using a conventional deposition technique, such as LPCVD, or spinning.

The dielectric element 16 may be formed with a generally planar surface (as shown in FIG. 1) or the dielectric element may be formed with a textured surface. A textured surface may be preferred in those embodiments in which the moveable membrane "sticks" to the underlying substrate during device operation. The MEMS phenomena related to the tendency of two mating MEMS surfaces to stick together is known in the art as stiction. By providing for a textured surface at the membrane to substrate interface less surface area is contacting the moveable membrane when the membrane reaches a "down" position and thus less force is necessary to overcome the stiction. Overcoming stiction allows the pump device to perform with greater reliability and improved cycle time. Textured surfaces are typically formed during fabrication and the implementation and fabrication of such surfaces is well known in the art.

A release layer (not shown in FIGS. 1 and 2), is deposited on the dielectric element 16 in the area generally underneath the distal portion 22 of the overlying moveable membrane 18. The release layer is patterned in such fashion that it only is deposited on those regions below the moveable membrane portions not being fixed to the underlying substrate structure. Preferably, the release layer comprises an oxide or other suitable material that may be etched away when acid is applied thereto. After the overlying layers of the moveable membrane have been deposited on the substrate, the release layer may be removed through standard microengineering acidic etching techniques, such as a hydrofluoric acid etch.

A textured surface may also be formed on the surface of the moveable membrane that is adjacent to the substrate after release operations. The textured surface of the moveable membrane may be formed by texturing the surface of the release layer that lies in contact with the flexible membrane. Upon release layer removal, the textured surface of the release layer is replicated by the surface of the flexible membrane that is formed thereon. As discussed above, a textured surface on the flexible membrane serves the same purpose as a textured surface formed on the dielectric element.

When the release layer has been removed, the distal portion 22 of moveable membrane 18 is separated from the underlying surface. The release of the moveable membrane from the substrate in conjunction with the biasing characteristics of the biasing element will typically result in the thin film membrane having a distal portion that has a curled shape. Biasing in the moveable membrane will typically result in the moveable membrane curling away from the substrate (as shown in FIG. 1) when no electrostatic force is applied. It is also possible to bias the moveable membrane such that it curls toward the substrate when no electrostatic force is applied.

Biasing in the moveable membrane may be accomplished by providing for biasing element and electrode element materials that differ in thickness, thermal coefficient of expansion or any other known biasing characteristic. Alternately, biasing may be induced during fabrication by employing process steps that create intrinsic stresses so as to curl the moveable membrane. For example, a polymeric biasing element can be deposited as a liquid and then cured at elevated temperatures so that it forms a solid biasing layer. Preferably, the biasing element may comprise a polymer material having a higher thermal coefficient of expansion than the electrode element. Next, the biasing element and the electrode element are cooled, inducing stresses in the membrane due to differences in the thermal coefficients of expansion. The moveable membrane curls because the polymeric biasing element shrinks faster than the electrode layer.

Additionally, providing differential thermal coefficients of expansion between the biasing element layers and the electrode element layer can create bias. Assuming an increase in temperature, the moveable membrane will curl toward the layer having the lower thermal coefficient of expansion because the layers accordingly expand at different rates. As such, the moveable membrane having two layers with different thermal coefficients of expansion will curl toward the layer having a lower thermal coefficient of expansion as the temperature rises. In addition, two polymer film layers having different thermal coefficients of expansion can be used in tandem with an electrode layer to bias the moveable membrane as necessary.

The layers of the moveable membrane 18 generally overlie the substrate electrode 14. Known integrated circuit manufacturing processes are used to construct the layers comprising moveable membrane 18. Preferably, one or more layers of the moveable membrane comprise the electrode element and one or more additional layers comprise the biasing element. As shown in FIG. 1, one preferred embodiment of the moveable membrane comprises an electrode element layer 24 positioned between two biasing element layers 26 and 28. It is also possible to configure the moveable membrane with an electrode element layer having only one biasing layer positioned on either side of the electrode element layer. The biasing element layer 26 may also serve as an insulator that allows for the complete electrical isolation between the substrate electrode and the electrode element of the moveable membrane.

The layers comprising the moveable membrane are formed from flexible materials, for instance, flexible polymers are used to form the biasing element layers 26 and 28 and flexible conductors are used to form the electrode element layer 24. In a preferred embodiment the biasing element layers will comprise a flexible polymer film, preferably, a polyimide material, however, other suitable flexible polymers capable of withstanding the release layer etch process can also be employed. Biasing element layers are typically deposited by using conventional spinning techniques or any other suitable deposition techniques may be used.

The electrode element 24 of the moveable membrane 18 preferably comprises a layer of flexible conductor material. The electrode element may be deposited directly upon the release layer or over the first biasing element layer 26, as depicted in FIG. 1. The electrode element preferably comprises gold, although other flexible conductors tolerant of release layer processing, such as conductive polymer films, may also be used. If gold is used to form the electrode element, a thin layer of chromium (not shown in FIG. 1) may be deposited prior to depositing the gold layer and/or following the gold layer to allow improved adhesion of the gold layer to the adjacent biasing element layers. The electrode element layer will typically be deposited by using a standard deposition technique, such as evaporation.

The number of layers, thickness of layers, arrangement of layers, and choice of materials used in the moveable membrane 18 may be selected to bias the moveable composite as required. In this sense, the biased position of the distal portion 22 of the moveable membrane can be customized to provide a desired volume for the pump region 30 (i.e. the area between the substrate and moveable membrane). The distal portion can be biased to curl away from the underlying planar surface of the substrate, as shown in FIG. 1. When the distal portion is biased to curl away from the substrate, the pump acts to move liquid or gaseous matter out from under the pump region.

FIG. 2 illustrates a plan view perspective of one embodiment of the MEMS pump device 10 in accordance with an embodiment of the present invention. As shown, the fixed portion 20 of the moveable membrane may extend beyond the distal portion 22 in the widthwise direction for the purpose of sufficiently anchoring the moveable membrane 18 to the substrate 12. In many embodiments it will not be necessary to provide for a fixed portion extension beyond the width of the distal portion. In the FIG. 2 embodiment the electrode element 24 is a unitary element that generally overlies the entirety of the moveable membrane. As will be shown in subsequent embodiment, the electrode element may comprise more than one element disposed within the moveable membrane that can be sequentially biased to perform optimal unidirectional pumping action. It should be noted that the simplified single moveable membrane configuration of this embodiment of the invention does not provide for optimal unidirectional flow of the liquid or gaseous matter. In this embodiment the pumped matter is allowed to flow in multiple directions, including the lengthwise direction 40 of the moveable membrane and in lateral directions that are outward from the lengthwise sides 42 and 44 of the moveable membrane. In most applications it will be desired to implement a pump device that limits the flow of the liquid or gas to be in one general direction. The following embodiments of the present invention provide for alternative pump devices that implement varied electrode element and moveable membrane configurations so as to provide for flow in one general direction.

Figure 3:
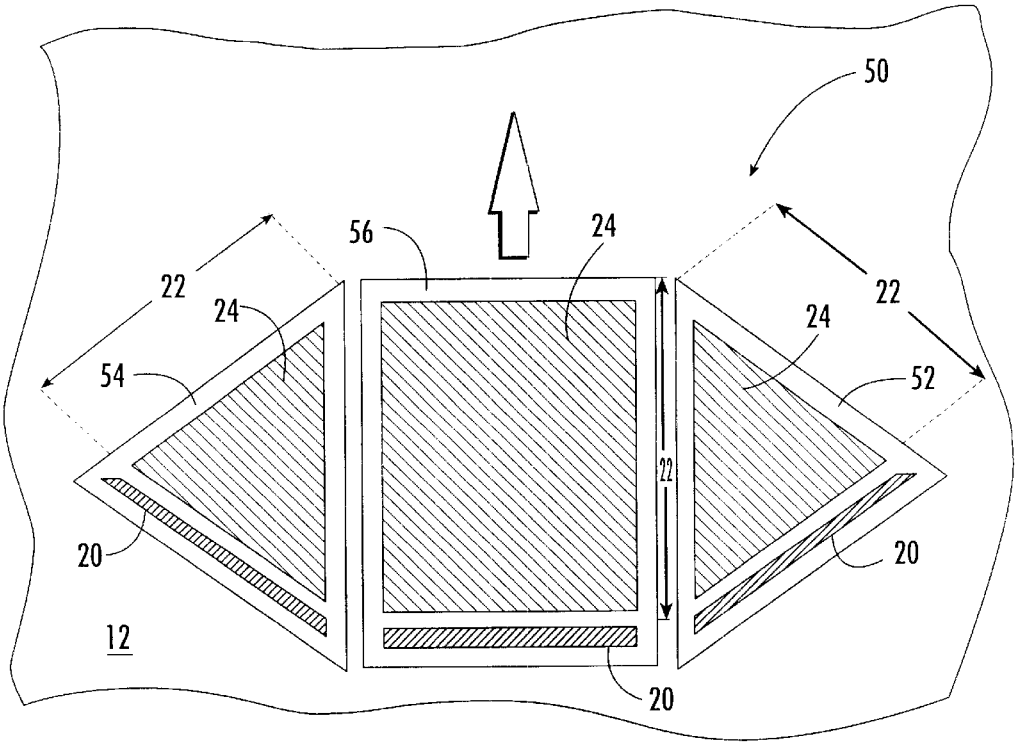
FIG. 3 is a top plan view of a MEMS pumping device comprising two triangular plan view shaped moveable membranes disposed adjacent to opposite sides of a rectangular plan view shaped moveable membrane in accordance with an embodiment of the present invention.

FIG. 3 illustrates a plan view perspective of a MEMS pump device 50 having three individual moveable membranes that work in unison to provide for fluid or gas flow in one general direction, in accordance with an embodiment of the present invention. The first and second triangular shaped moveable membranes 52 and 54 are positioned along lengthwise sides of rectangular shaped moveable composite 56. Each moveable membrane has a fixed portion 20 that is attached to the substrate 12 and a distal portion 22 that extends from the fixed portion and is released from the underlying substrate. As shown in FIG. 3 each moveable membrane has a singular electrode element 24 that generally extends across the entirety of the plan view surface area of the distal portion of the moveable membrane. The substrate electrode (not shown in FIG. 3) may comprise a singular substrate electrode that generally underlies the three moveable membranes or the substrate electrode may comprise three separate electrodes each of which underlies a corresponding electrode element in an individual moveable membrane. In the embodiments which have individual substrate electrodes underlying the electrode elements in the moveable membranes it is possible to sequence the biasing of the membranes to maximize the flow of the liquid or gas in the desired direction. For instance, the triangular membranes 52 and 54 may be biased prior to the biasing of the rectangular membrane 56 to minimize the amount of lateral flow.

Figure 4:
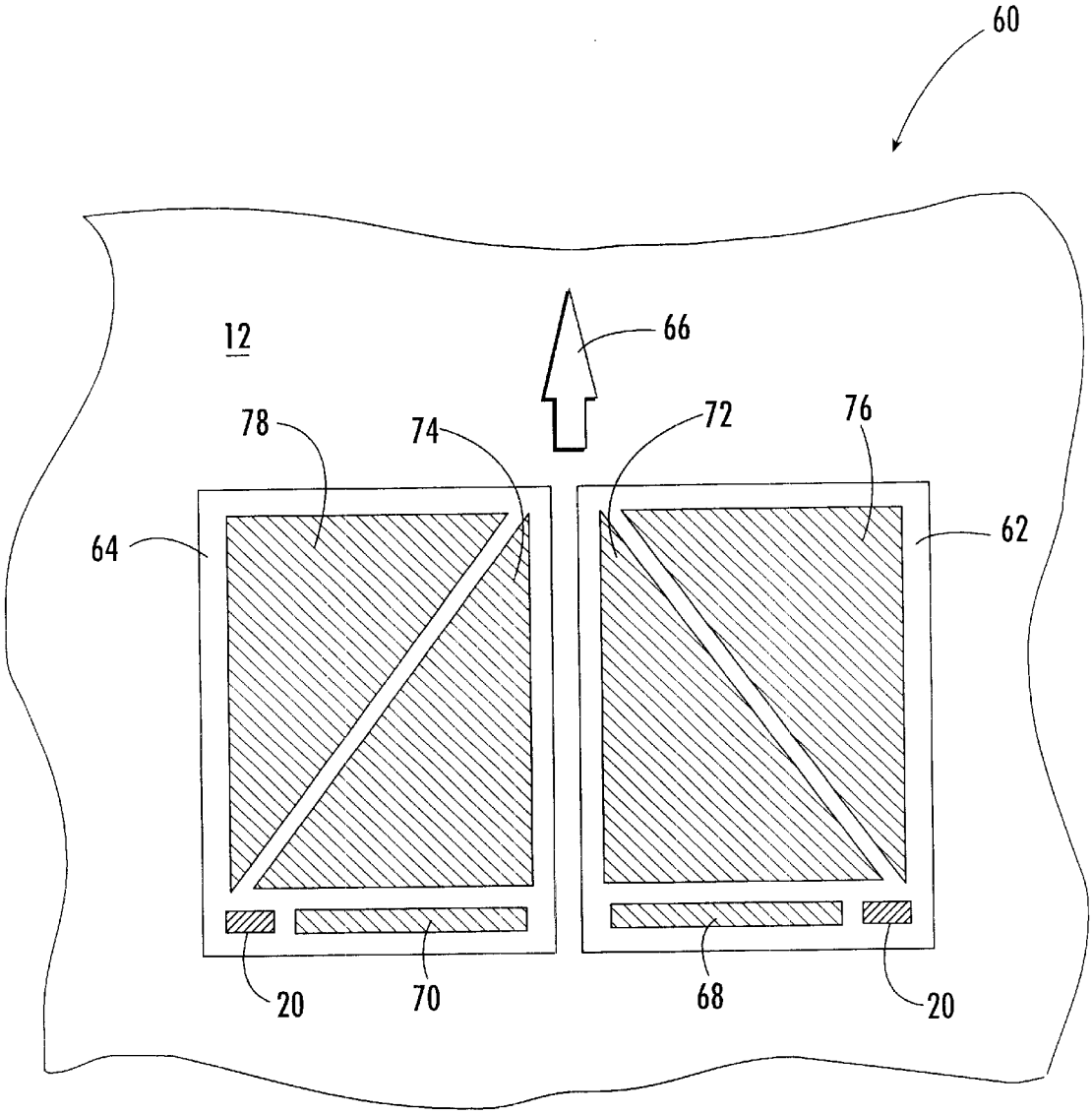
FIG. 4 is a top plan view of a MEMS pumping device comprising two adjacent rectangular plan view shaped moveable membranes. The moveable membranes have segmented electrode elements that can be biased sequentially to provide optimal pumping efficiency, in accordance with an embodiment of the present invention.

FIG. 4 illustrates a plan view perspective of a MEMS pump device 60 having two individual moveable membranes that work in unison to provide for fluid or gas flow in one general direction, in accordance with an embodiment of the present invention. In this embodiment of the invention the individual membranes 62 and 64 have three distinct flexible electrode elements that are biased individually to maximize net flow in the desired direction 66. The two rectangular plan view shaped membranes are disposed proximate to one another on the surface of the substrate. Each membrane has a fixed portion 20 that occupies only a corner of each membrane. By limiting the fixed portion to a corner of each membrane, it allows for refilling of the fluid or gas "inside" the pump to be accomplished from "behind" the pump (i.e. upstream of the pump device) as opposed to the refilling occurring laterally along the sides of the pump.

In operation the FIG. 4 MEMS pump device 60 is sequentially biased as follows. Initially, a bias is applied only to the rectangular plan view shaped electrodes 68 and 70. In effect, this creates an "attached" upstream, edge of each of the membranes similar to the fixed portion shown in the moveable membranes of FIGS. 2 and 3. The remaining electrodes are unbiased and, thus, the remainder of the moveable membrane is positioned so that it generally curls away from the underlying substrate. While maintaining bias on electrodes 68 and 70, a bias is then applied to the interior triangular plan view shaped electrodes 72 and 74, followed by a bias being applied to the exterior triangular plan view shaped electrodes 76 and 78. This biasing sequence acts to insure a fluid or gaseous flow is maximized in the desired direction 66. The bias can also be applied simultaneously to the two pairs of triangular electrodes 72, 74 and 76, 78. At this point in the pumping operation all the electrodes in the moveable membranes have been attracted to the substrate, forcing the pumped matter out from under the moveable membranes in the desired direction of flow.

The sequence by which biasing is removed from the electrodes provides for further increased net flow in the desired direction 66. Bias is first removed from the rectangular plan view shaped electrodes 68 and 70, followed by the removal of biasing from the internal triangular plan view shaped electrodes 72 and 74. This sequencing allows the upstream edges of the moveable membranes to become "unattached" from the substrate and fill the pumping region with liquid or gas from the upstream side of the pump. Next, biasing is removed from the external triangular plan view shaped electrodes 76 and 78 to complete the filling process of the pump region cavity. Once the pump region is filled, the overall process repeats itself by applying bias to the rectangular plan view shaped electrodes 68 and 70. This sequential biasing and unbiasing process, allows for the filling operation of the pump cavity to assist in generating a net flow in the desired direction.

Figure 5:
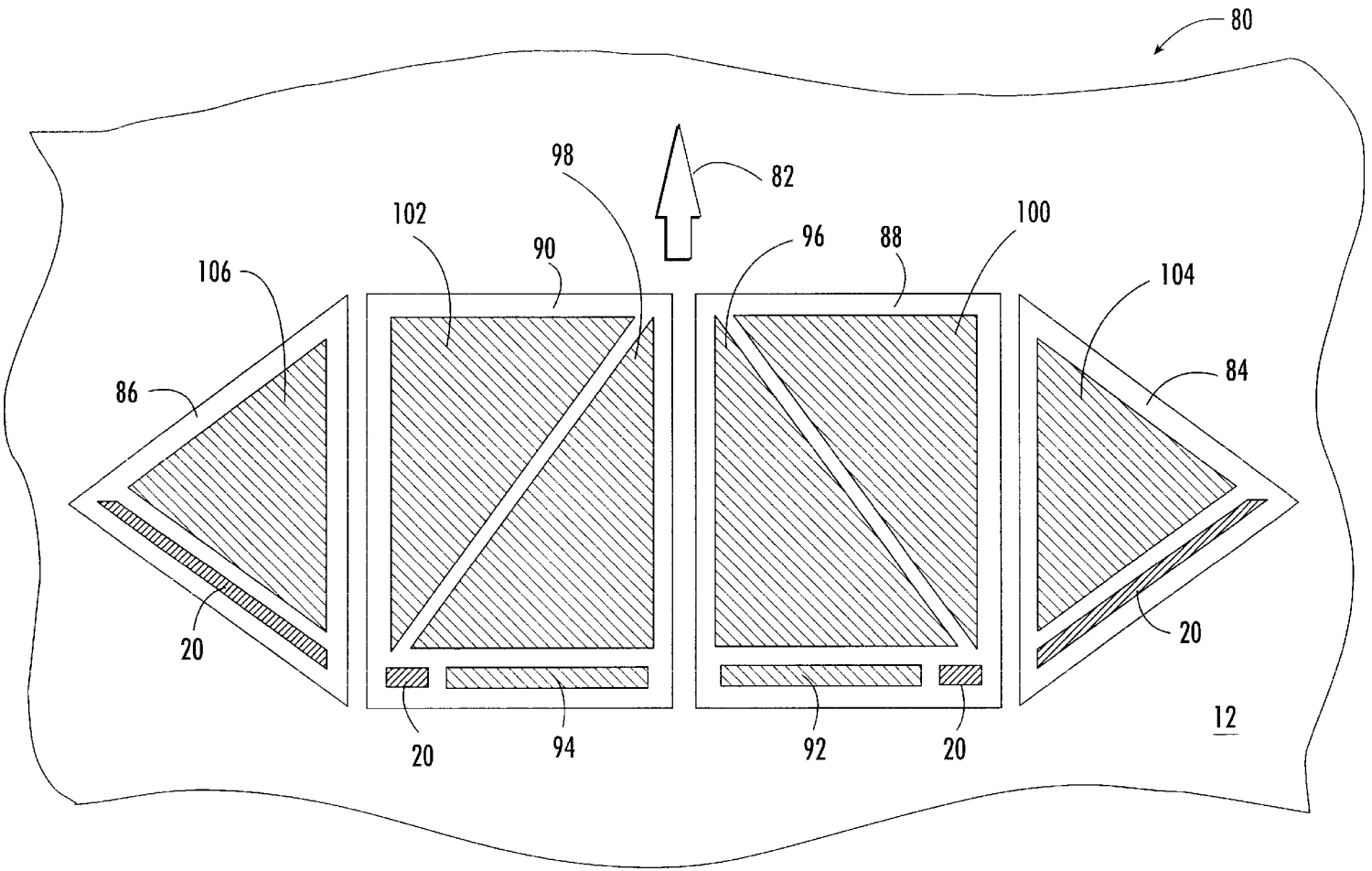
FIG. 5 is a top plan view of a MEMS pumping device comprising two adjacent rectangular plan view shaped moveable membranes and two triangular plan view shaped moveable membranes disposed adjacent to the exterior sides of the rectangular plan view shaped moveable membranes, in accordance with an alternate embodiment of the present invention.

FIG. 5 illustrates a plan view perspective of a MEMS pump device 80 having four individual moveable membranes that work in unison to provide for fluid or gas flow in one desired direction 82, in accordance with an embodiment of the present invention. This embodiment incorporates the triangular plan view shaped moveable membranes of the embodiment shown in FIG. 3 with the multi-electrode element embodiment shown in FIG. 4. This embodiment operates in a similar fashion to the embodiment shown in FIG. 4, however, it also incorporates the use of the triangular plan shaped moveable membranes 84 and 86 to further insure greater net flow in the desired pumping direction.

In operation the FIG. 5 MEMS pump device 80 is sequentially biased as follows. Initially, a bias is applied only to the rectangular plan view shaped electrodes 92 and 94. In effect, this creates an "attached" upstream, edge of each of the rectangular shaped moveable membranes 88 and 90 similar to the fixed portion shown in the moveable membranes of FIGS. 2 and 3. The remaining electrodes are unbiased and, thus, the remainder of the moveable membrane is positioned so that it generally curls away from the underlying substrate. While maintaining bias on electrodes 88 and 90 a bias is then applied to the interior triangular plan view shaped electrodes 96 and 98, followed by a bias being applied to the exterior triangular plan view shaped electrodes 100 and 102 and finally a bias is applied to the electrodes 104 and 106 in the triangular shaped moveable membrane 84 and 86. The bias can also be applied simultaneously to the four triangular plan view shaped electrodes 96, 98, 100 and 102 and/or simultaneously to the four triangular plan view shaped electrodes and the remaining electrodes 104 and 106. This biasing sequence acts to insure a fluid or gaseous flow is maximized in the desired direction 82. At this point in the pumping operation all the electrodes in the moveable membranes have been attracted to the substrate, forcing the pumped matter out from under the moveable membranes in the desired direction of flow.

The sequence by which biasing is removed from the electrodes provides for further increased net flow in the desired direction. Bias is first removed from the rectangular plan view shaped electrodes 92 and 94, followed by the removal of biasing from the internal triangular plan view shaped electrodes 96 and 98. Next, biasing is removed from the electrode elements 104 and 106 of the triangular shaped membranes 84 and 86. This sequencing allows the upstream edges of the moveable membranes to become "unattached" from the substrate and fill the pumping region with liquid or gas from the upstream side of the pump. Finally, biasing is removed from the external triangular plan view shaped electrodes 100 and 102 to complete the filling process of the pump region cavity. The bias can also be released first to triangular plan view shaped electrodes 100 and 102 followed by electrodes 104 and 106 or the bias can be released simultaneously. Once the pump region is filled, the overall process repeats itself by applying bias to the rectangular plan view shaped electrodes 92 and 94. This sequential biasing and unbiasing process, allows for the filling operation of the pump cavity to assist in generating a net flow in the desired direction.

The pumping devices of the present invention may be arranged in array formation on the surface of the substrate, in accordance with a further embodiment of the present invention. Array formations of pumping devices allow for pumping action to take place over the entire enclosed region of a conduit, chamber or the like. The entire fluid or gas in the enclosed region can be pumped since the boundary of the fluid is moving where the drag force exists. The ability to provide continuous and uniform pumping action is highly advantageous in various micro-applications, such as biomedical. For example, the pumping of semi-fluids or slurries will typically require the matter to maintain uniform consistency and viscosity throughout the pumping process. The predetermined placement of the pumping devices of the present invention throughout the interior walls of the pumping cavity allow for mixture consistency to remain uniform throughout the pumping process. The configuration of the pumping device array is not limiting, and numerous array configurations are possible. The selection of the array configuration may be predetermined so as to maximize the desired pumping force, the desired direction of flow, the adaptability of directional flow and the like. Additionally, the orientation of the pumping devices in the array may be varied to provide the capability to selectively power individual pumping devices or groups of pumping devices, and hence direct the pumped matter in desired directions. A random placement and operation of the pumping devices in the array can be used to mix the pumped matter.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A MEMS (Micro Electro Mechanical System) electrostatic pump device, comprising:

a substrate;

a plurality of individually addressable substrate electrodes disposed upon said substrate;

a first moveable membrane generally overlying said plurality of individually addressable substrate electrodes, the first moveable membrane comprising at least one electrode element and a biasing element, wherein the first moveable membrane includes a fixed portion attached to said substrate and a distal portion extending from the fixed portion, the distal portion being moveable with respect to said plurality of individually addressable substrate electrodes; and a dielectric element disposed between said plurality of individually addressable substrate electrodes and said at least one electrode element of said first moveable membrane, wherein a voltage differential established between said plurality of individually addressable substrate electrodes and said at least one electrode element moves said first moveable membrane relative to said substrate to thereby controllably distribute matter residing between the substrate and the distal portion of said first moveable membrane.

2. The MEMS electrostatic pump device of claim 1, further comprising a second moveable membrane, the second moveable membrane comprising at least one electrode element and a biasing element, wherein the second moveable membrane includes a fixed portion attached to said substrate and a distal portion extending from the fixed portion, the distal portion being moveable with respect to said plurality of individually addressable substrate electrodes.

3. The MEMS electrostatic pump device of claim 2, wherein the first and second moveable membranes controllably move relative to said substrate to thereby distribute matter residing between the substrate and the distal portions of said first and second membranes.

4. The MEMS electrostatic pump device of claim 2, wherein said second moveable membrane is disposed on said substrate adjacent to said first moveable membrane.

5. The MEMS electrostatic pump device of claim 2, wherein said first and second moveable membranes have generally rectangular top plan view shapes and generally equivalent top plan view areas.

6. The MEMS electrostatic pump device of claim 1, wherein said at least one electrode element of said first moveable membrane further comprise a plurality of individually addressable electrode elements to controllably activate predetermined regions in the first moveable membrane.

7. The MEMS electrostatic pump device of claim 2, wherein said at least one electrode element of said first and second moveable membranes further comprise a plurality of individually addressable electrode elements to controllably activate predetermined regions in the first and second moveable membranes, respectively.

8. The MEMS electrostatic pump device of claim 1, further comprising second and third moveable membranes, each of the second and third moveable membranes comprising an electrode element and a biasing element, wherein each of the second and third moveable membranes includes a fixed portion attached to said substrate and a distal portion extending from the fixed portion, the distal portion being moveable with respect to said plurality of individually addressable substrate electrodes.

9. The MEMS electrostatic pump device of claim 8, wherein the first, second and third moveable membranes controllably move relative to said substrate to thereby distribute matter residing between the substrate and the distal portions of said first, second and third moveable membranes.

10. The MEMS electrostatic pump device of claim 8, wherein said second and third moveable membranes are disposed adjacent to opposite sides of said first moveable membrane.

11. The MEMS electrostatic pump device of claim 8, wherein said first moveable membrane has a generally rectangular top plan view shape and said second and third moveable membranes have a generally triangular top plan view shape.

12. The MEMS electrostatic pump device of claim 11, wherein said second and third moveable membranes have a generally equivalent top plan view area.

13. The MEMS electrostatic pump device of claim 11, wherein said first, second and third moveable membranes are disposed on said substrate such that a top plan view side of said second moveable membrane and a top plan view side of said third moveable membrane are adjacent to opposite top plan view sides of said first moveable membrane in the direction of movement.

14. The MEMS electrostatic pump device of claim 8, wherein said at least one electrode element of said first moveable membrane further comprise a plurality of individually addressable electrode elements to controllably activate predetermined regions in the first moveable membrane.

15. The MEMS electrostatic pump device of claim 8, wherein said at least one electrode element of said first, second and third moveable membranes further comprise a plurality of individually addressable electrode elements to controllably activate predetermined regions in the first, second and third moveable membranes.

16. The MEMS electrostatic pump device of claim 1, further comprising a second, third and fourth moveable membrane, each of the second, third and fourth moveable membranes comprising an electrode element and a biasing element, wherein each of the second, third and fourth moveable membrane includes a fixed portion attached to said substrate and a distal portion extending from the fixed portion, the distal portion being moveable with respect to said plurality of individually addressable substrate electrodes.

17. The MEMS electrostatic pump device of claim 16, wherein the first, second, third and fourth moveable membranes controllably move relative to said substrate to thereby distribute matter residing between the substrate and the distal portions of said first, second, third and fourth moveable membrane.

18. The MEMS electrostatic pump device of claim 16, wherein said first and second moveable membranes have a generally equal-area, rectangular plan view shape and said third and fourth moveable membranes have a generally equal-area, triangular plan view shape.

19. The MEMS electrostatic pump device of claim 16, wherein said first and second, moveable membranes are disposed on said substrate such that top plan view sides of said first and second moveable membranes are adjacent in the direction of movement.

20. The MEMS electrostatic pump device of claim 16, wherein said third and fourth moveable membranes are disposed on said substrate such that one side of said third moveable membrane is adjacent to a side of said first moveable membrane that is opposite said second moveable membrane and one side of said fourth moveable membrane is adjacent to a side of said second moveable membrane that is opposite said first moveable membrane.

21. The MEMS electrostatic pump device of claim 16, wherein said at least one electrode element of said first and second moveable membranes further comprise a plurality of individually addressable electrode elements to controllably activate predetermined regions in the first and second moveable membranes.

22. The MEMS electrostatic pump device of claim 16, wherein said at least one electrode element of said first, second, third and fourth moveable membranes further comprise a plurality of individually addressable electrode elements to controllably activate predetermined regions in the first, second, third and fourth moveable membranes.

23. The MEMS electrostatic PUMP device according to claim 1, wherein said at least one electrode element and said biasing element have different thermal coefficients of expansion.

24. The MEMS electrostatic pump device according to claim 1, wherein said biasing element comprises at least two polymer films of different thickness.

25. The MEMS electrostatic pump device according to claim 1, wherein said biasing element comprises at least two polymer films of different thermal coefficients of expansion.

26. The MEMS electrostatic pump device according to claim 1, wherein the distal portion of said moveable membrane is biased so as to curl away from said substrate in the absence of an electrostatic force between said electrode element and said plurality of individually addressable substrate electrodes.

27. The MEMS electrostatic pump device according to claim 1, wherein the distal portion of said moveable membrane is biased so as to curl toward said substrate in the absence of an electrostatic force between said electrode element and said plurality of individually addressable substrate electrodes.

28. The MEMS electrostatic pump device according to claim 1, further comprising a source of electrostatic energy electrically connected to at least one of said plurality of individually addressable substrate electrodes and said at least one electrode element.

29. A MEMS electrostatic pump device, comprising:

a substrate;

at least one substrate electrode disposed upon said substrate;

a first moveable membrane having a generally rectangular top plan view shape that generally overlies said at least one substrate electrode;

a second moveable membrane having a generally rectangular top plan view shape that generally overlies said at least one substrate electrode;

a third moveable membrane having a generally triangular top plan view shape that generally overlies said at least one substrate electrode;

a fourth moveable membrane having a generally triangular top plan view shape that generally overlies said at least one substrate electrode, wherein said first, second, third and fourth moveable membranes each comprise at least one electrode element and a biasing element, wherein said first, second, third and fourth moveable membranes each include a fixed portion attached to said substrate and a distal portion extending from the fixed portion, the distal portion being moveable with respect to said substrate electrode; and a dielectric element disposed between said at least one substrate electrode and said at least one electrode element of said first, second, third and fourth moveable membranes, whereby a voltage differential established between said at least one substrate electrode and said at least one electrode element of said first, second, third and fourth moveable membranes moves said first, second, third and fourth moveable membranes relative to said substrate to thereby controllably distribute matter residing between the substrate and the distal portion of said first, second, third and fourth moveable membranes.

30. A MEMS (Micro Electro Mechanical System) electrostatic pump device, comprising:

a substrate;

at least one substrate electrode disposed upon said substrate;

a first moveable membrane generally overlying said at least one substrate electrode, the first moveable membrane comprising a plurality of individually addressable electrode elements to controllably activate predetermined regions in the first moveable membrane and a biasing element, wherein the first moveable membrane includes a fixed portion attached to said substrate and a distal portion extending from the fixed portion, the distal portion being moveable with respect to said substrate electrode; and a dielectric element disposed between said at least one substrate electrode and said at least one electrode element of said first moveable membrane, wherein a voltage differential established between said at least one substrate electrode and said at least one of said plurality of individually addressable electrode elements moves said first moveable membrane relative to said substrate to thereby controllably distribute matter residing between the substrate and the distal portion of said first moveable membrane.

31. The MEMS electrostatic pump device of claim 30, further comprising a second moveable membrane, the second moveable membrane comprising at least one electrode element and a biasing element, wherein the second moveable membrane includes a fixed portion attached to said substrate and a distal portion extending from the fixed portion, the distal portion being moveable with respect to said substrate electrode.

32. The MEMS electrostatic pump device of claim 31, wherein the first and second moveable membranes controllably move relative to said substrate to thereby distribute matter residing between the substrate and the distal portions of said first and second membranes.

33. The MEMS electrostatic pump device of claim 31, wherein said second moveable membrane is disposed on said substrate adjacent to said first moveable membrane.

34. The MEMS electrostatic pump device of claim 31, wherein said at least one substrate electrode further comprise a first substrate electrode generally underlying said first moveable membrane and a second substrate electrode generally underlying said second moveable membrane.

35. The MEMS electrostatic pump device of claim 30, wherein said at least one substrate electrode further comprise a plurality of individually addressable substrate electrodes disposed upon said substrate and corresponding to said plurality of individually addressable electrode elements in said first moveable membrane to controllably activate predetermined regions in the first moveable membrane.

36. The MEMS electrostatic pump device of claim 31, wherein said at least one electrode element of the second moveable membrane further comprise a plurality of individually addressable electrode elements to controllably activate predetermined regions in the second moveable membrane.

37. The MEMS electrostatic pump device of claim 30, further comprising second and third moveable membranes, each of the second and third moveable membranes comprising an electrode element and a biasing element, wherein each of the second and third moveable membranes includes a fixed portion attached to said substrate and a distal portion extending from the fixed portion, the distal portion being moveable with respect to said substrate electrode.

38. The MEMS electrostatic pump device of claim 37, wherein the first, second and third moveable membranes controllably move relative to said substrate to thereby distribute matter residing between the substrate and the distal portions of said first, second and third moveable membranes.

39. The MEMS electrostatic pump device of claim 37, wherein said second and third moveable membranes are disposed on the substrate adjacent to opposite sides of said first moveable membrane.

40. The MEMS electrostatic pump device of claim 37, wherein said at least one substrate electrode further comprises a first substrate electrode generally underlying said first moveable membrane, a second substrate electrode generally underlying said second moveable membrane and a third substrate electrode generally underlying said third moveable membrane.

41. The MEMS electrostatic pump device of claim 37, wherein said at least one electrode element of said second and third moveable membranes further comprise a plurality of individually addressable electrode elements to controllably activate predetermined regions in the second and third moveable membranes.

42. The MEMS electrostatic pump device of claim 41, wherein said at least one substrate electrode further comprise a plurality of individually addressable substrate electrodes disposed upon said substrate corresponding to the plurality of individually addressable electrode elements in the first, second and third moveable membranes to controllably activate predetermined regions in the first, second and third moveable membranes.

43. The MEMS electrostatic pump device of claim 30, further comprising second, third and fourth moveable membranes, each of the second, third and fourth moveable membranes comprising an electrode element and a biasing element, wherein each of the second, third and fourth moveable membrane includes a fixed portion attached to said substrate and a distal portion extending from the fixed portion, the distal portion being moveable with respect to said substrate electrode.

44. The MEMS electrostatic pump device of claim 43, wherein the first, second, third and fourth moveable membranes controllably move relative to said substrate to thereby distribute matter residing between the substrate and the distal portions of said first, second, third and fourth moveable membrane.

45. The MEMS electrostatic pump device of claim 43, wherein said at least one substrate electrode further comprises a first substrate electrode generally underlying said first moveable membrane, a second substrate electrode generally underlying said second moveable membrane, a third substrate electrode generally underlying said third moveable membrane and a fourth substrate electrode generally underlying said fourth moveable membrane.

46. The MEMS electrostatic pump device of claim 43, wherein said at least one electrode element of said second, third and fourth moveable membranes further comprise a plurality of individually addressable electrode elements to controllably activate predetermined regions in the first, second, third and fourth moveable membranes.

47. The MEMS electrostatic pump device of claim 46, wherein said at least one substrate electrode further comprise a plurality of individually addressable substrate electrodes disposed upon said substrate and corresponding to said plurality of individually addressable electrode elements of said first, second, third, fourth moveable membranes to controllably activate predetermined regions in the first, second, third and fourth moveable membranes.

48. A MEMS (Micro Electro Mechanical System) electrostatic pump device, comprising:

a substrate;

at least one substrate electrode disposed upon said substrate;

a first moveable membrane generally overlying said at least one substrate electrode, the first moveable membrane comprising at least one electrode element and a biasing element that includes two polymer film layers on opposite sides of said at least one electrode element, wherein the first moveable membrane includes a fixed portion attached to said substrate and a distal portion extending from the fixed portion, the distal portion being moveable with respect to said substrate electrode; and a dielectric element disposed between said at least one substrate electrode and said at least one electrode element of said first moveable membrane, wherein a voltage differential established between said at least one substrate electrode and said at least one electrode element moves said first moveable membrane relative to said substrate to thereby controllably distribute matter residing between the substrate and the distal portion of said first moveable membrane.

49. The MEMS electrostatic pump device of claim 48, further comprising a second moveable membrane, the second moveable membrane comprising at least one electrode element and a biasing element, wherein the second moveable membrane includes a fixed portion attached to said substrate and a distal portion extending from the fixed portion, the distal portion being moveable with respect to said substrate electrode.

50. The MEMS electrostatic pump device of claim 49, wherein the first and second moveable membranes controllably move relative to said substrate to thereby distribute matter residing between the substrate and the distal portions of said first and second membranes.

51. The MEMS electrostatic pump device of claim 49, wherein said second moveable membrane is disposed on said substrate adjacent to said first moveable membrane.

52. The MEMS electrostatic pump device of claim 49, wherein said at least one substrate electrode further comprise a first substrate electrode generally underlying said first moveable membrane and a second substrate electrode generally underlying said second moveable membrane.

53. The MEMS electrostatic pump device of claim 48, wherein said at least one electrode element of said first moveable membrane further comprise a plurality of individually addressable electrode elements to controllably activate predetermined regions in the first moveable membrane.

54. The MEMS electrostatic pump device of claim 48, wherein said at least one substrate electrode further comprise a plurality of individually addressable substrate electrodes disposed upon said substrate to controllably activate predetermined regions in the first moveable membrane.

55. The MEMS electrostatic pump device of claim 49, wherein said at least one electrode element of said first and second moveable membranes further comprise a plurality of individually addressable electrode elements to controllably activate predetermined regions in the first and second moveable membranes, respectively.

56. The MEMS electrostatic pump device of claim 49, wherein said at least one substrate electrode further comprise a plurality of individually addressable substrate electrodes disposed upon said substrate to controllably activate predetermined regions in the first and second moveable membranes.

57. The MEMS electrostatic pump device according to claim 48, wherein the distal portion of said moveable membrane is biased so as to curl away from said substrate in the absence of an electrostatic force between said electrode element and said substrate electrode.

58. The MEMS electrostatic pump device according to claim 48, further comprising a source of electrostatic energy electrically connected to at least one of said substrate electrode and said at least one electrode element.

* * * * *